US006205228B1

(12) United States Patent
Czerwinski et al.

(10) Patent No.: US 6,205,228 B1
(45) Date of Patent: Mar. 20, 2001

(54) HORN LOADED PLEATED RIBBON HIGH FREQUENCY ACOUSTIC TRANSDUCER WITH SUBSTANTIALLY UNIFORM COUPLING

(75) Inventors: Eugene J. Czerwinski, Chatsworth; Terry Karstensen, Van Nuys; Kirk Armstrong, Toluca Lake; Alexander Voishvillo, Simi Valley; Laszlo M. Megyeri, Newbury Park, all of CA (US)

(73) Assignee: Cerwin-Vega, Inc., Simi Valley, CA (US)

( * ) Notice: Subject to any disclaimer, the term of this patent is extended or adjusted under 35 U.S.C. 154(b) by 0 days.

(21) Appl. No.: 09/307,318

(22) Filed: May 7, 1999

Related U.S. Application Data

(63) Continuation of application No. PCT/US97/20202, filed on Nov. 6, 1997.

(60) Provisional application No. 60/030,230, filed on Nov. 7, 1996, and provisional application No. 60/029,550, filed on Nov. 8, 1996.

(51) Int. Cl.[7] ..... H04R 25/00

(52) U.S. Cl. ..... 381/340; 381/399; 381/343

(58) Field of Search ..... 381/340, 342, 381/399, 408, 431, 412, FOR 156, FOR 143, FOR 163, 341, 343; 181/152

(56) References Cited

U.S. PATENT DOCUMENTS 3,832,499 * 8/1974 Heil ..... 381/408

5,325,439 * 6/1994 Smiley ..... 381/399

* cited by examiner

*Primary Examiner*—Huyen Le

(74) *Attorney, Agent, or Firm*—Fulbright & Jaworski L.L.P.

(57) ABSTRACT

An electro-dynamic acoustic transducer has a pleated diaphragm in which an accordion-like alternating movement of the adjacent pleats is perpendicular to the radiation (acoustic) axis of the transducer. Front and rear pole plates cooperate to provide a magnetic field across the active area of the diaphragm. Each pole plate may be a "magnetic throat" constructed from a unitary casting of a ferrous magnetic material (such as an iron silicon alloy) having a number of apertures. In an exemplary embodiment, the open area at the rear of the pole plate may be approximately ⅓ the active area of the diaphragm, thereby providing a compression ratio of 3:1. The apertures are substantially uniformly distributed over the effective area of the diaphragm, to provide uniform acoustical coupling and prevent the occurrence of acoustical resonances and standing waves along the diaphragm's length. Each aperture in the front plate opens up such that the corresponding area at the inlet of the loading horn is substantially open, thereby providing a smooth transition through the magnetic pole plate to the external horn, with the apertures preferably designed with an exponential flare. These apertures may be tapered as part of the magnetic pole plate or the tapered portions may be formed separately from magnetic or non-magnetic materials, such as plastic or aluminum, and joined to a pole plate having corresponding apertures. In a preferred embodiment, each aperture is in the form of a horizontal slit extending across the active width of the diaphragm, and the apertures are arranged in a vertical array to cover this entire active area. Each slit increases in width as it tapers towards the front pole plate, providing the smoothest possible acoustical transition to the external horn.

8 Claims, 8 Drawing Sheets

HORN LOADED PLEATED RIBBON HIGH FREQUENCY ACOUSTIC TRANSDUCER WITH SUBSTANTIALLY UNIFORM COUPLING

CLAIM TO PRIORITY

This application is a continuation PCT/US97/20202 filed Nov. 6, 1997. This application is based on, and claims priority from, US Provisional Applications 60/030,230 filed Nov. 7, 1996 and 60/029,550 filed Nov. 8, 1996, which are hereby incorporated by reference in their entirety.

TECHNICAL FIELD OF THE INVENTION

The present invention relates generally to electrodynamic acoustic transducers, and more particularly to a transducer having a pleated diaphragm in which an accordion-like alternating movement of the adjacent pleats is perpendicular to the radiation (acoustic) axis of the transducer.

BACKGROUND OF THE INVENTION

U.S. Pat. No. 3,832,499 (Oscar Heil) discloses an electroacoustic transducer in which a conductor is arranged in a meander pattern on at least one side of a flexible diaphragm. The flexible diaphragm is pleated or corrugated such that when the diaphragm is placed in a magnetic field oriented in a front to rear axis, with electrical current flowing perpendicular to the magnetic field in one direction in a given fold and in an opposite direction in an adjacent fold, the adjacent folds are alternately displaced to the right and to the left along a third axis perpendicular to both the front to rear axis and to the direction of the electrical current. The air spaces between adjacent folds facing one side of the diaphragm are expanded while the air spaces on the other side are contracted, thereby causing acoustic radiation to be propagated along the front to rear axis.

A two-part article in Speaker Builder (March and April 1982) by Kenneth Rauen discloses alternate designs for the diaphragm of a horn loaded "Heil Air Motion Transformer" ("AMT"), based in part on techniques previously published by Neil Davis (Audio Amateur, February 1977)

Another design for a horn loaded AMT is disclosed in U.S. Pat. No. 5,325,439 (Smiley) and was incorporated in a coaxial speaker marketed by Cerwin Vega (applicant's assignee) as model CATA-15.

However, none of the known prior art designs for a pleated diaphragm transducer provide for both substantially uniform acoustical coupling of the entire effective area of the diaphragm and substantially uniform magnetic flux through that same effective area. Furthermore, no previously known prior art design provides sufficient acoustical loading to match the mechanical impedance of the diaphragm and therefore such prior art designs are unable to maximize the efficiency of the transducer. Accordingly, the known prior art pleated diaphragm transducers are not readily adaptable for high power and high sound pressure level applications such as sound systems for concerts and motion picture theaters.

SUMMARY OF THE INVENTION

Accordingly, it is an overall object of the present invention to overcome the limitations of the prior art.

In accordance with one aspect of the invention, the front pole plate is a "magnetic throat" constructed from a unitary casting of a ferrous magnetic material (such as an iron silicon alloy), with a number of apertures extending from the front surface of the diaphragm to the inlet of an external loading horn. In an exemplary embodiment, the open area at the rear of the pole plate may be approximately ⅓ the active area of the diaphragm, thereby providing a compression ratio of 3:1.

In an alternate embodiment, the "magnetic throat" is constructed by stacking plates of a suitable cast or machined ferrous magnetic material, perpendicular to the radiation axis of the diaphragm, with each aperture formed by opposing recesses in two adjacent plates.

Yet another embodiment may be constructed by the layering of laminations of perforated steel, with each wafer being oriented perpendicular to the radiation axis of the diaphragm. Each consecutive wafer contains circular perforations of an increasing diameter, such that when the wafers are lined up in sequence the apertures register and form a stepped flare that opens outwards from the pole plate to the external horn.

In accordance with another aspect of the invention, the apertures are substantially uniformly distributed over the effective area of the diaphragm, to provide uniform acoustical coupling and prevent the occurrence of acoustical resonances and standing waves along the diaphragm's length.

In accordance with yet another aspect of the invention, each aperture opens up towards the front of the magnetic throat, such that the corresponding area at the inlet of the loading horn is substantially open, thereby providing a smooth transition through the magnetic pole plate to the external horn, with the apertures preferably designed with an exponential flare. These apertures may be tapered as part of the magnetic pole plate or the tapered portions may be formed separately from magnetic or non-magnetic materials, such as plastic or aluminum, and joined to a pole plate having corresponding apertures.

In a preferred embodiment, each aperture is in the form of a horizontal slit extending across the active width of the diaphragm, and the apertures are arranged in a vertical array to cover this entire active area. Each slit increases in width as it tapers towards the front pole plate, providing the smoothest possible acoustical transition to the external horn.

In other embodiments, the magnetic throat may comprise a plurality of apertures arranged in a planar array comprising several rows and several columns. In such cases, each aperture may open up in either the horizontal or vertical plane, or preferably in both.

DETAILED DESCRIPTION OF THE INVENTION

Figure 1:
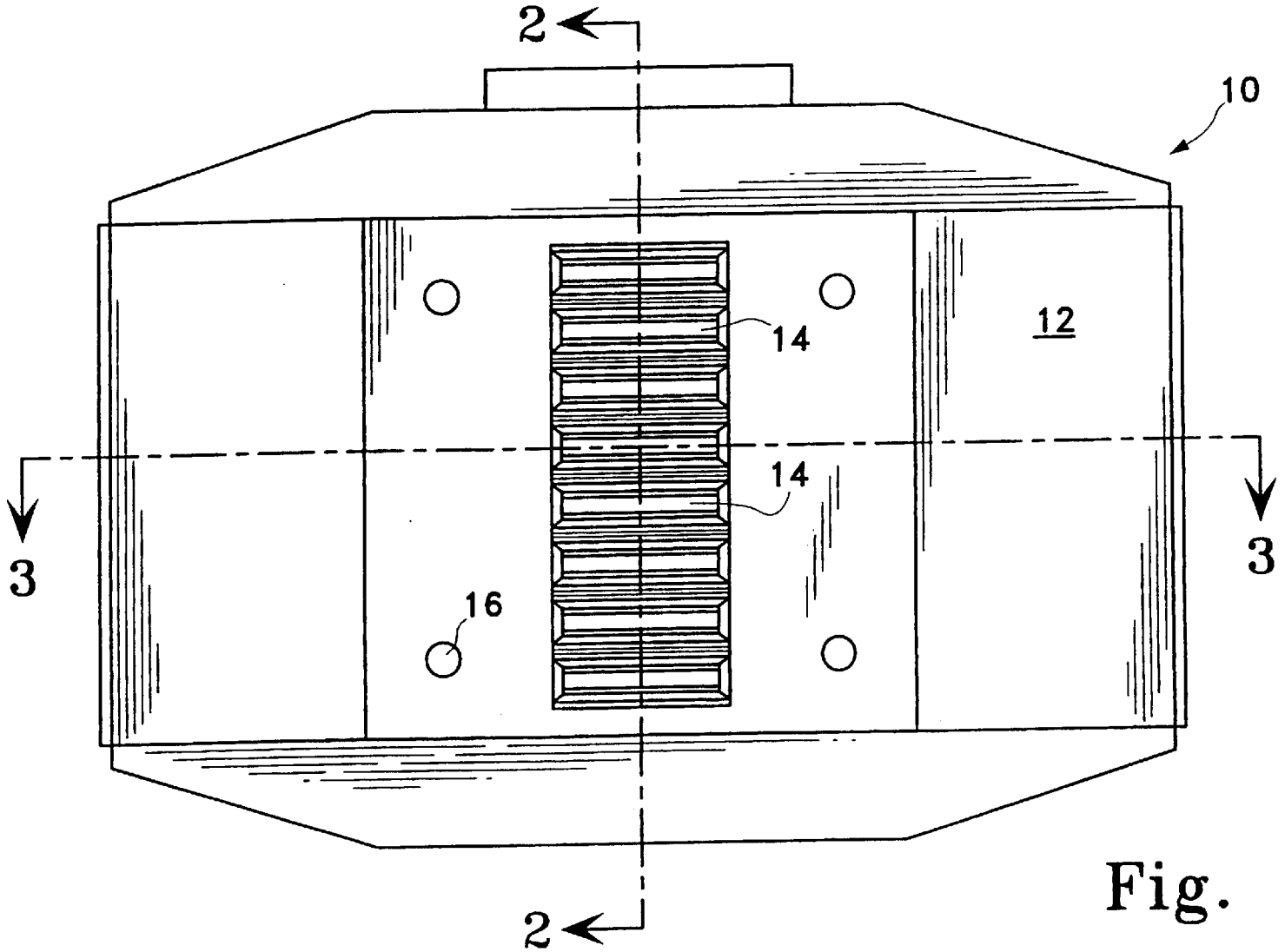
FIG. 1 is a front view of a preferred embodiment of the AMT driver, without the front loading horn.
Figure 3:
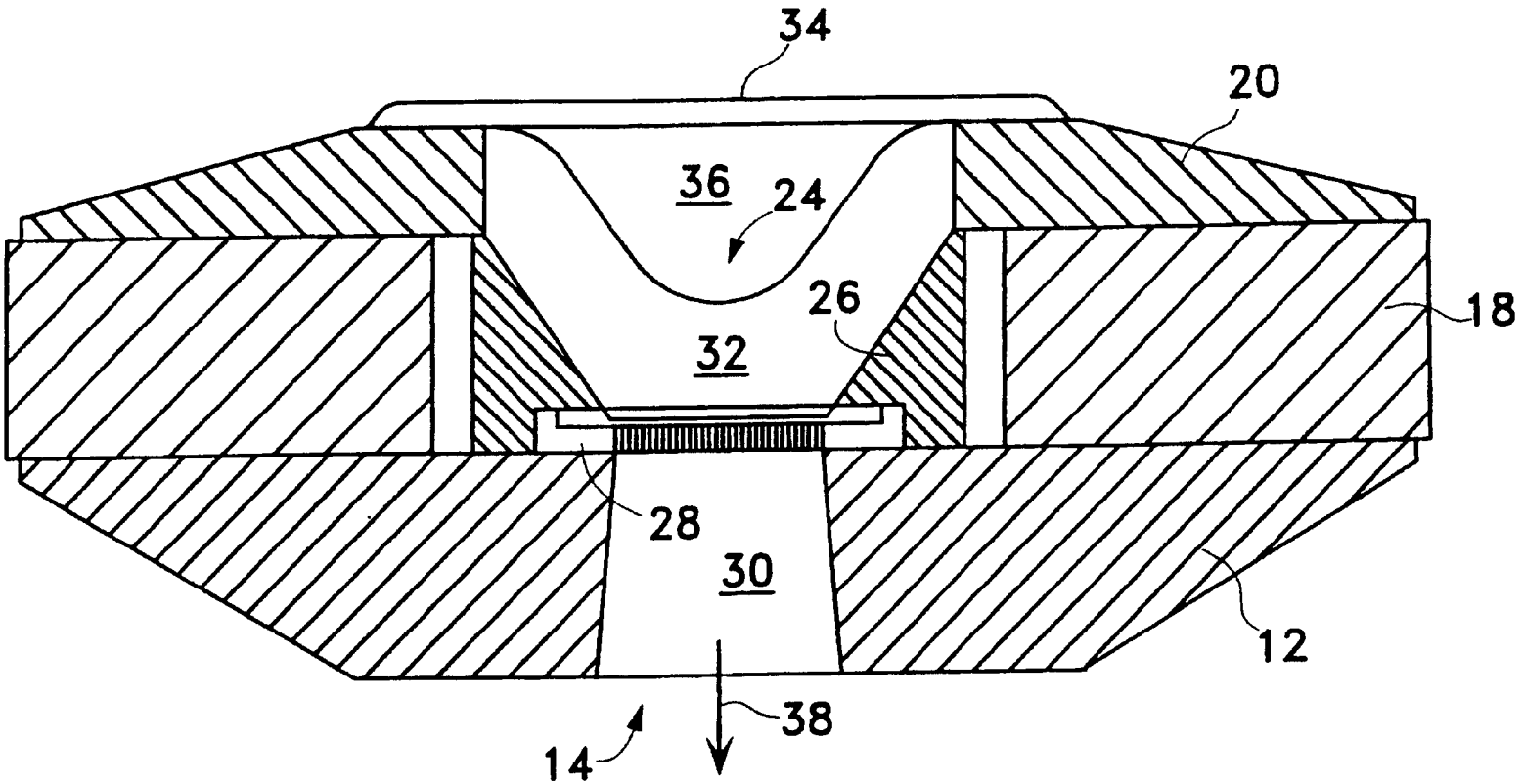
FIG. 3 is a horizontal cross-section of FIG. 1, taken along line B—B.

FIG. 1 is a front view, from the radiation axis, of a preferred embodiment electro-dynamic acoustic transducer 10 without the front loading horn attached. This elevation depicts the front unitary iron casting 12 with the magnetic throat flares 14 cast as an integral component. As shown in FIG. 3, the four circular holes 16 are used to assemble or "sandwich" two magnets 18 between the front 12 and rear 20 pole plates. In an alternate form of construction (not shown) the front pole plate 12 can be constructed by the stacking of a plurality of steel plates each oriented in the direction of section line 2—2, to from a structure of a similar shape and magnetic properties.

Figure 2:
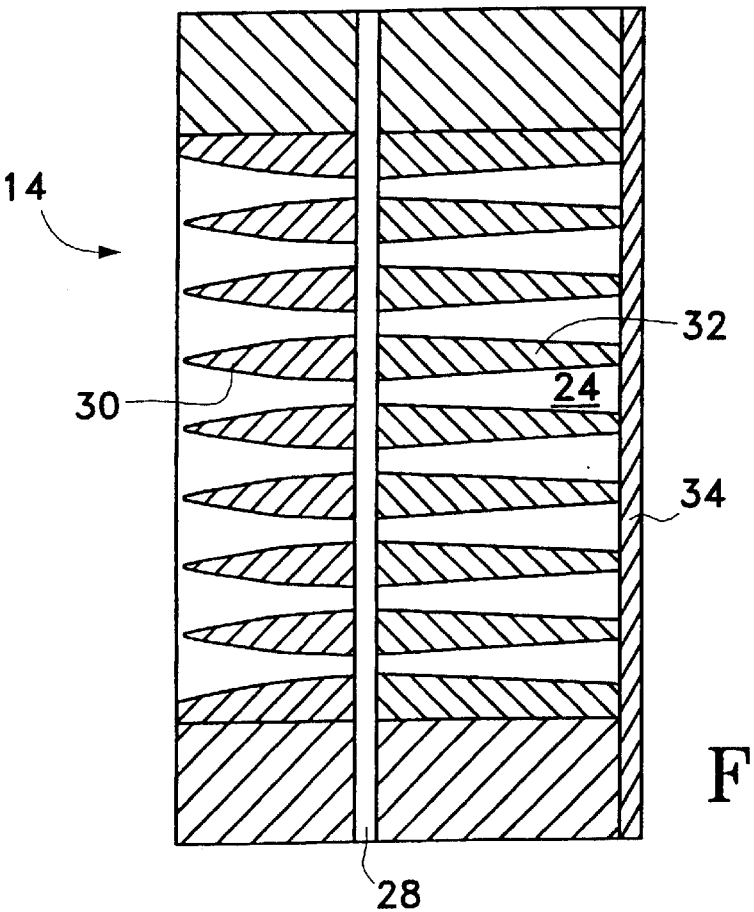
FIG. 2 is a vertical cross-section of FIG. 1, taken along line A—A.

FIG. 2 is a cross-sectional view of FIG. 1 along section line 2—2. In this view the details of the tapered apertures 14, 24 in the front and rear plates are clearly visible, as is the spacer 26 for forming a channel between with the two plates 12, 20 for the diaphragm "card" 28 (See also FIG. 3). Also visible in FIG. 2 is the preferred 3:1 ratio of open area to closed area in the vicinity of the active area of the diaphragm, which tapers to a 100% open area at the front surface of the front plate 12.

FIG. 3 is a cross-sectional view of FIG. 1 along axis 3—3, showing how the front pole plate 12 and the rear pole plate 20 provide a path for magnetic flux from the two pole magnets 18 across the active area of the diaphragm 28, via the front bridging portions 30 of front throat 14 and the corresponding rear bridging portions 32 of rear throat 20 (See also FIG. 2). The two bar magnets 18 are symmetrical and can be fabricated from a number of magnetic materials such as ceramic, Alnico or Neodymium or the like. The spacer block 26 is sandwiched between the two plates 12, 20 and is designed to receive and hold in place the diaphragm "card" 28, which may be of the type described and claimed in the referenced provisional application.

The rear cover 34 can be manufactured from any non-ferrous material and although not depicted in FIG. 3, can have a multitude of shapes including half round, square, geometric, and can contain various volumes 36 depending on the application of the transducer. The primary function of this plate/cover is to contain the rear radiating energy and to seal out dust and dirt from falling into the diaphragm 28. Alternatively, cover 34 may be omitted in which case the acoustical energy would radiate in a "Bi-polar" (front & rear) fashion, simultaneously, in which case the front and rear pole plates could be of identical construction.

The diaphragm 28 is preferably sealed against air leakage by foam or other compliant material (not shown). Higher sound pressure levels can be achieved by reducing the gap between the front and rear pole plates 12, 20, hence increasing the magnetic induction in the gap. This reduced gap will necessitate a decrease in the depth of the pleats within the diaphragm. Such a decrease in pleat depth raises the frequency of the diaphragm's fundamental mechanical resonance and therefore causes a decrease in sound pressure levels at lower frequencies.

Figure 4:
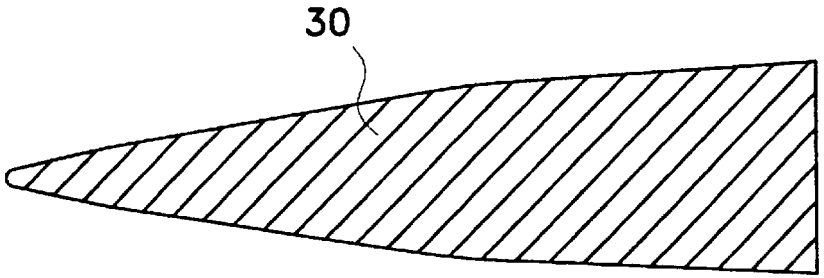
FIG. 4 is a detail of one of the walls between two adjacent slits.

FIG. 4 is an enlarged view of the proportions of an individual flared front bridging portion 30 clearly showing the preferred tapered profile between the rear open area and the front open area.

Figure 5:
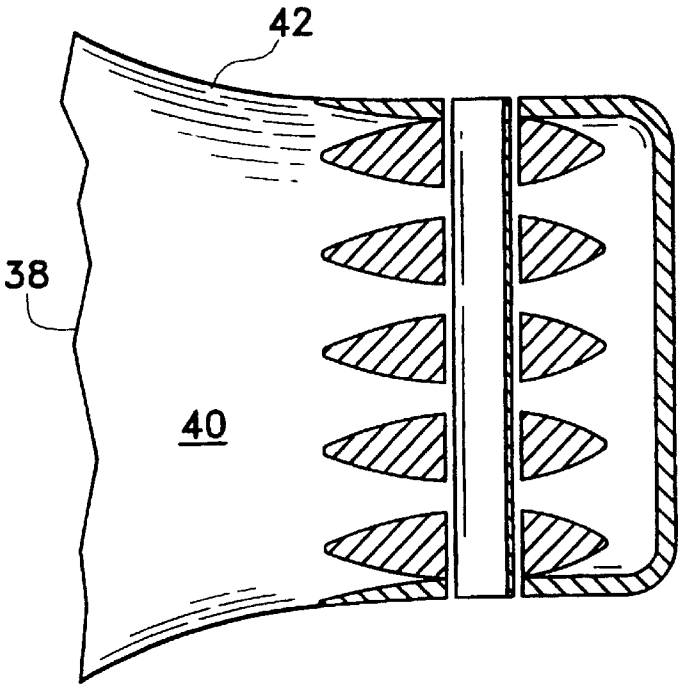
FIG. 5 is a conceptual drawing in vertical cross-section showing the relationship of the magnetic throat, the diaphragm and the horn.

FIG. 5 is a somewhat schematic sectional view generally corresponding to FIG. 2, but with fewer apertures 14 and is used to show the purpose and relationship of the tapered apertures in the front and rear to the overall design, whereby the rear, tapered apertures 24 cooperate with the rear volume 36 and the rear cover 34 to provide a "reactive" acoustical loading on the diaphragm and increase the overall efficiency of the device on the radiation axis 38. The front, tapered apertures 14 serve to symmetrically "horn load" the front radiation of the diaphragm and provide a smooth acoustical transition to the interior portion 40 of the horn 42 mounted in front of the diaphragm card 28.

Figure 6:
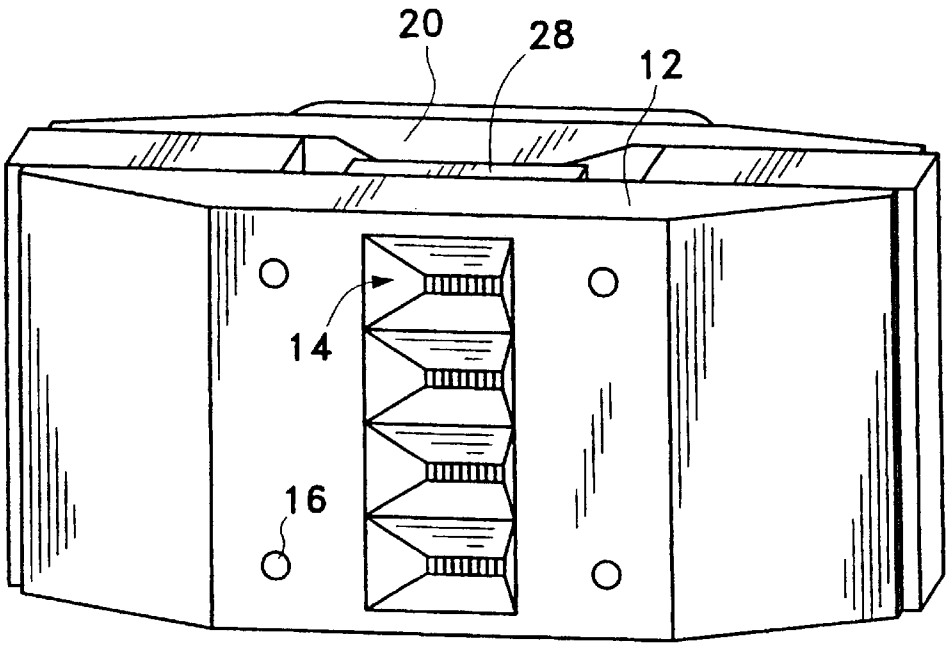
FIG. 6 is another conceptual drawing showing how the walls between adjacent slits function as a "phase plug".

FIG. 6 is an isometric view of FIGS. 1–3, but with an alternate number of front apertures 14, and clearly shows how apertures are tapered with a substantially exponential flare along both the horizontal (width) and vertical (height) axes and function as a "phase plug" for optimal loading & frequency response.

Figure 7:
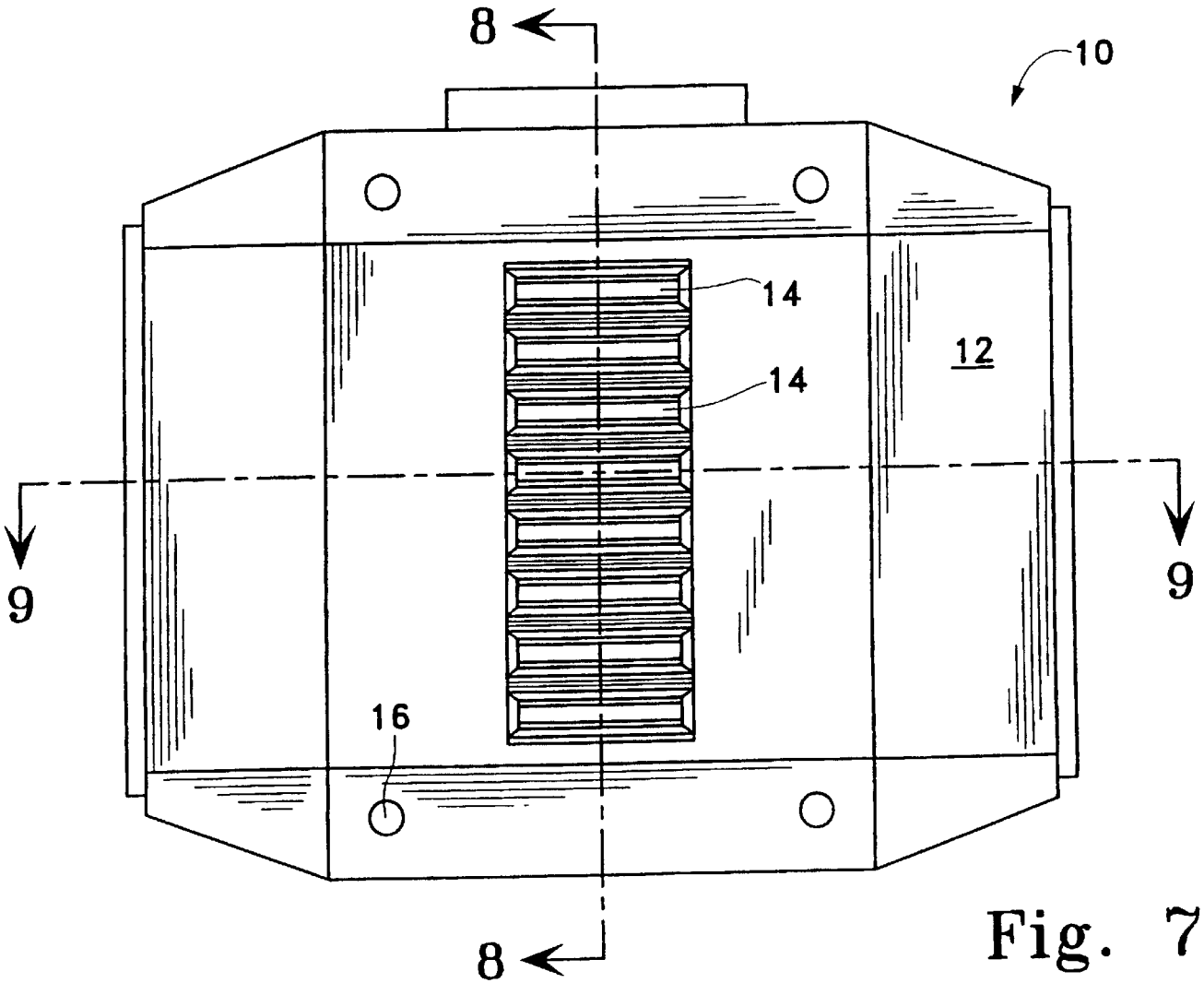
FIG. 7 corresponds generally to FIG. 1, showing an alternate embodiment with a T-shaped rear pole plate.
Figure 9:
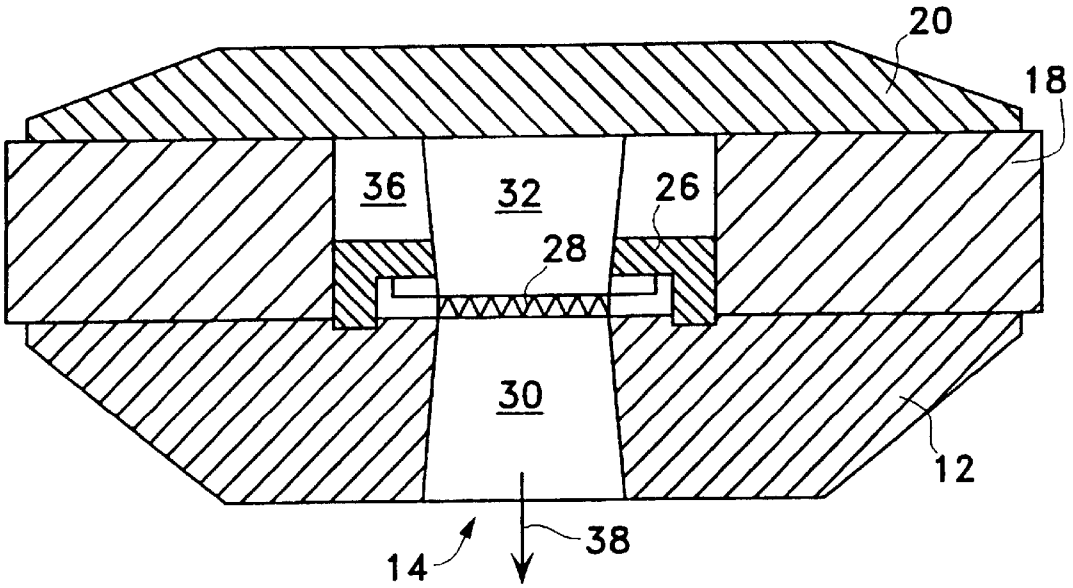
FIG. 9 is a horizontal cross-section of FIG. 7, taken along line B—B
Figure 8:
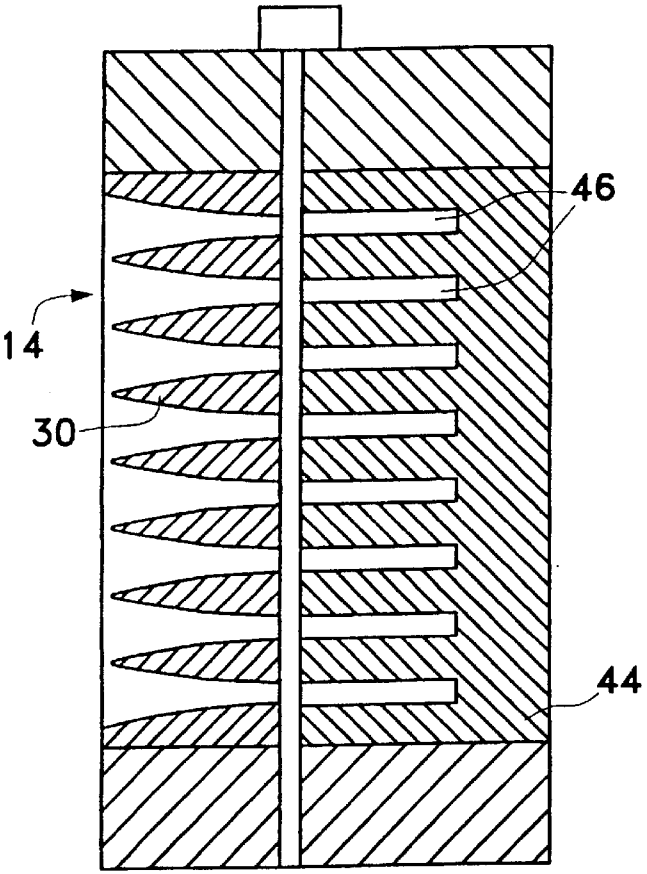
FIG. 8 is a vertical cross-section of FIG. 7, taken along line A—A.

FIGS. 7–9 depict an alternate embodiment with a T-shaped rear pole plate 44, which confines the rear acoustical radiation from the diaphragm to integrally formed blind apertures 46.

Figure 10:
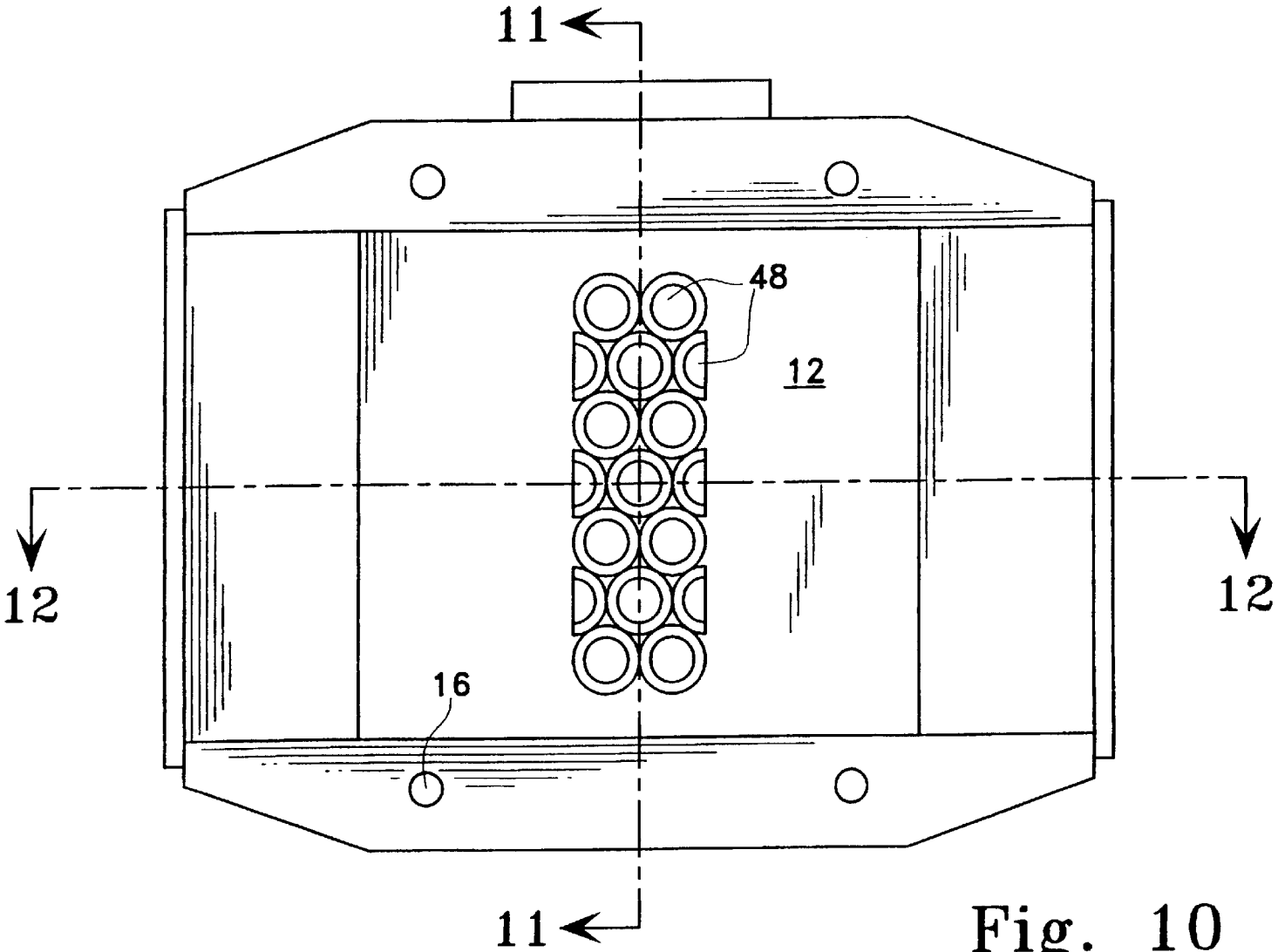
FIG. 10 corresponds generally to FIG. 1, showing a second alternate embodiment with several apertures in each row.
Figure 12:
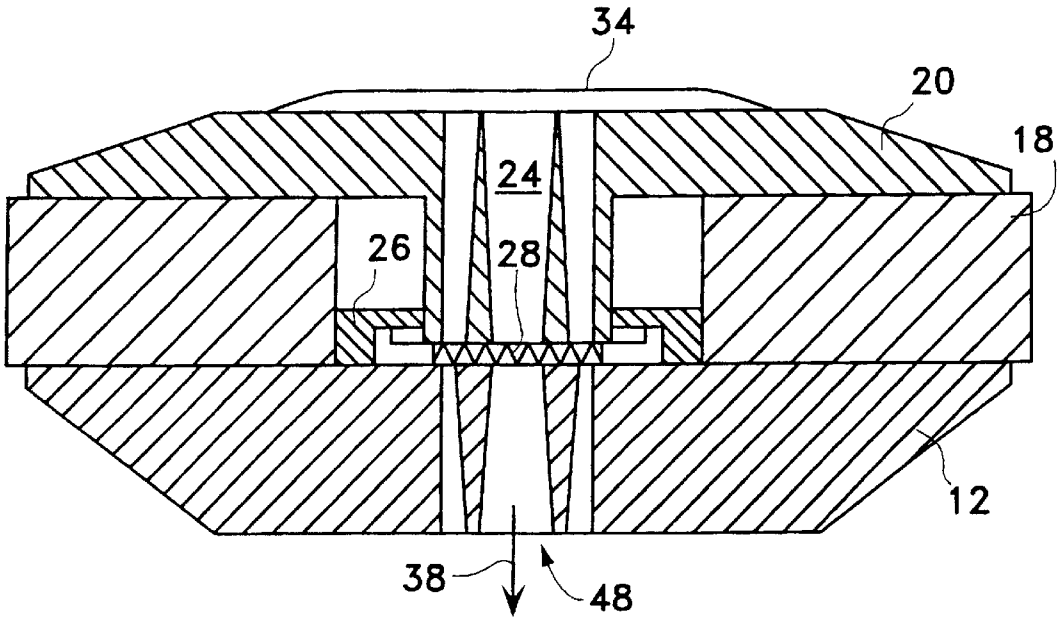
FIG. 12 is a horizontal cross-section of FIG. 10, taken along line B—B.
Figure 11:
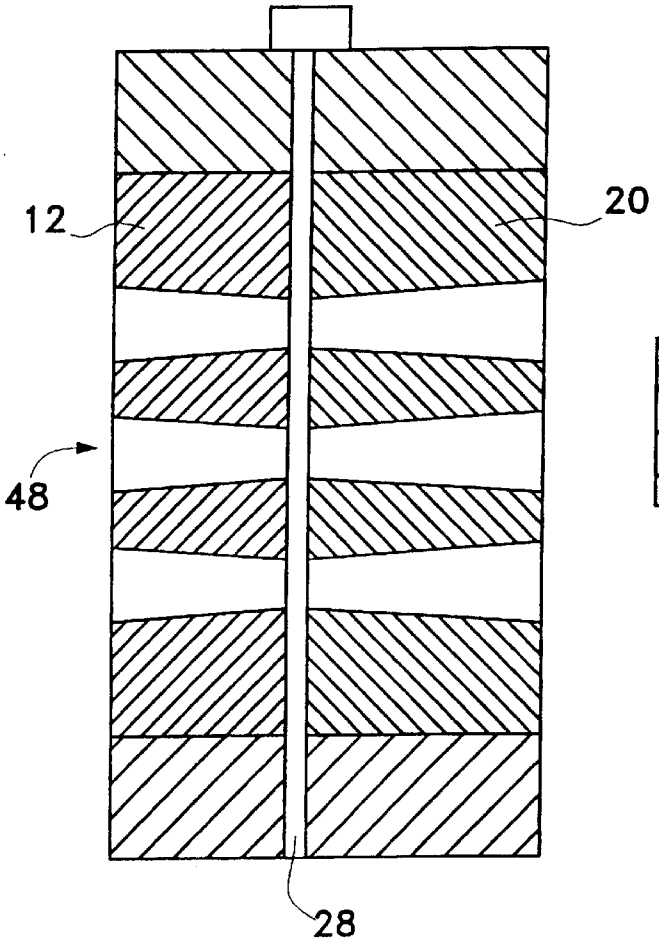
FIG. 11 is a vertical cross-section of FIG. 10, taken along line A—A.

FIGS. 10–12 depict yet another modification of FIG. 1 having a number of circular apertures 48 arranged hexagonally in a number of rows and columns. The circular apertures are tapered as in the preferred embodiment of FIGS. 1–4 for proper loading & horn coupling.

The horn and diaphragm may be constructed in known fashion, as exemplified by the above mentioned prior art devices; however, diaphragm 28 is preferably designed to facilitate heat transfer to the diaphragm frame, which is in turn designed to transfer heat to the pole plates. Moreover, the diaphragm frame is preferably provided with a spring mechanism to keep the folds of the diaphragm taut and to counteract any rippling of the material due to thermal expansion. Such a spring mechanism prevents unwanted contact between the conductive strands placed on adjacent vibrating surfaces that would result in short-circuiting and even failure of the diaphragm. An example of such a preferred diaphragm is described in the referenced priority document.

Other modifications will be apparent to those skilled in the art. For example, the rear chamber may be provided with external vents and/or damping material As another example, the two bar magnets at either side connected by front and rear pole plates could be replaced with a single magnet, and/or the two magnets (or the single magnet) could be located in the center, with magnetic pole plates at either side.

What is claimed is:

1. An electrodynamic electro-acoustic transducer having an acoustic axis, said transducer comprising:

a pleated ribbon diaphragm having a plurality of half-pleats each extending along a first direction perpendicular to the acoustic axis of the transducer and each adapted to move in an accordion-like manner in a second direction perpendicular to both said first direction and to said acoustic axis of the transducer, said first and second directions defining a diaphragm plane;

an electrical conductor comprising one or more conductive strands each extending along a respective one of said half pleats parallel to the diaphragm plane;

a horn having at least an outer portion that is perpendicular to the diaphragm plane;

a magnetic front pole plate extending across a front side of an active area of the diaphragm and disposed between said active area and the horn for providing an acoustic conduit between said active area and the horn a rear pole plate extending across a rear side of the active area and cooperating with the magnetic front pole plate for orienting a magnetic field in a direction perpendicular to said active area, wherein:

the front and rear pole plates each comprises a plurality of openings, each of the openings in the front pole plate extends from a rear surface adjacent the active area of the diaphragm transducer to a front surface adjacent an interior portion of the horn, the rear open area of each of the openings in said rear surface is less than the corresponding front open area of that same opening in said front surface, and the ratio of rear open area to the front open area in the front pole plate is substantially constant for all portions of the active area of the diaphragm.

2. The transducer of claim 1 wherein the open area increase in a substantially exponential fashion from the rear surface to the front surface.

3. The transducer of claim 1 wherein the open area increases in two axes that are each perpendicular to the acoustical axis of the horn.

4. The transducer of claim 1 wherein the magnetic front pole plate is integrally formed from a single plate of magnetic material.

5. The transducer of claim 1 wherein the magnetic front pole plate comprises a plurality of slits arranged in a vertical array and each extending horizontally across all of the conductive segments.

6. The transducer of claim 1 wherein the magnetic front pole plate comprises a plurality of apertures arranged in a planar array comprising several rows and several columns.

7. The transducer of claim 1 wherein the height of each of the openings increases from the rear surface to the front surface.

8. The transducer of claim 1 wherein the width of each of the openings increases from the rear surface to the front surface.

* * * * *